United States Patent [19]

Gilman et al.

[11] Patent Number: 4,627,959

[45] Date of Patent: Dec. 9, 1986

[54] PRODUCTION OF MECHANICALLY ALLOYED POWDER

[75] Inventors: Paul S. Gilman, Suffern, N.Y.; Walter E. Mattson, West Milford, N.J.

[73] Assignee: Inco Alloys International, Inc., Huntington, W. Va.

[21] Appl. No.: 745,890

[22] Filed: Jun. 18, 1985

[51] Int. Cl.[4] ..... B22F 1/00

[52] U.S. Cl. ..... 419/61; 75/0.5 R; 241/5; 241/26; 241/27; 241/DIG. 14; 420/533; 264/122; 264/123; 264/125

[58] Field of Search ..... 75/0.5 R, 0.5 B; 420/533; 148/11.5 A, 11.5 P, 11.5 Q, 126.1, 127; 419/23, 61; 241/5, 26, 27, DIG. 14; 264/122, 123, 125

[56] References Cited

U.S. PATENT DOCUMENTS

| | | | |
|---|---|---|---|
| 3,591,362 | 7/1971 | Benjamin | 75/0.5 BA |
| 3,623,849 | 11/1971 | Benjamin | 29/182.8 |
| 3,660,049 | 5/1972 | Benjamin | 29/182.8 |
| 3,696,486 | 10/1972 | Benjamin | 29/182.5 |
| 3,723,092 | 3/1973 | Benjamin | 75/0.5 R |
| 3,728,088 | 4/1973 | Benjamin | 29/182.5 |
| 3,737,300 | 6/1973 | Cairns et al. | 75/0.5 BC |
| 3,738,817 | 6/1973 | Benjamin | 29/182.5 |
| 3,740,210 | 6/1973 | Bomford et al. | 75/0.5 AC |
| 3,746,581 | 7/1973 | Cairns et al. | 148/11.5 F |
| 3,749,612 | 7/1973 | Benjamin et al. | 148/11.5 F |
| 3,785,801 | 1/1974 | Benjamin | 75/0.5 BC |
| 3,809,545 | 5/1974 | Benjamin | 75/0.5 R |
| 3,814,635 | 6/1974 | Cometto et al. | 148/11.5 R |
| 3,816,080 | 6/1974 | Bomford et al. | 29/182.5 |
| 3,830,435 | 8/1974 | Hill | 241/27 |
| 3,837,930 | 9/1974 | Cairns et al. | 148/11.5 F |
| 3,844,847 | 10/1974 | Bomford et al. | 148/11.5 F |
| 3,865,572 | 2/1975 | Fisher et al. | 75/0.5 R |
| 3,877,930 | 4/1975 | Volin | 75/0.5 R |
| 3,912,552 | 10/1975 | Schultz et al. | 148/31 |
| 3,926,568 | 12/1975 | Benjamin et al. | 29/182.5 |
| 4,134,852 | 1/1979 | Volin | 252/472 |
| 4,292,079 | 9/1981 | Pickens et al. | 75/232 |
| 4,297,136 | 10/1981 | Pickens et al. | 75/206 |
| 4,409,038 | 10/1983 | Weber | 148/12.7 A |
| 4,443,249 | 4/1984 | Weber et al. | 75/0.5 R |
| 4,532,106 | 7/1985 | Pickens | 419/19 |

*Primary Examiner*—Stephen J. Lechert, Jr.

*Attorney, Agent, or Firm*—Miriam W. Leff; Raymond J. Kenny

[57] ABSTRACT

An improved method is provided for producing mechanically alloyed powders on a commercial scale comprising milling the components of the powder product in a gravity-dependent-type ball mill to produce a powder having a characteristic apparent density. Powder so produced will have reached an acceptable processing level and will meet one criterion for determining whether it will be suitable for further processing to the end product.

30 Claims, 5 Drawing Figures

PRODUCTION OF MECHANICALLY ALLOYED POWDER

TECHNICAL FIELD

This invention relates to powder metallurgy, and more particularly to an improved method for producing mechanically alloyed powder on a commercial scale.

RELATED PRIOR ART

The following patents, which are incorporated herein by reference, are exemplary of issued patents which disclose methods of producing mechanically alloyed composite powders and consolidated products made therefrom: U.S. Pat. Nos. 3,591,362; 3,623,849; 3,660,049; 3,696,486, 3,723,092; 3,728,088; 3,737,300; 3,738,817; 3,740,210; 3,746,581; 3,749,612; 3,785,801; 3,809,549; 3,814,635; 3,816,080; 3,830,435; 3,837,930, 3,844,847; 3,865,572; 3,877,930; 3,912,552; 3,926,568; 4,134,852; 4,292,079; 4,297,136; 4,409,038; and 4,443,249.

BACKGROUND OF THE INVENTION

In the aforementioned patents, a method is disclosed for producing metal powders comprised of a plurality of constituents mechanically alloyed together such that each of the particles is characterized metallographically by an internal structure in which the starting constituents are mutually interdispersed within each particle. In general, production of such particles involves the dry, intensive, impact milling of powder particles such that the constituents are welded and fractured continuously and repetitively until, in time, the intercomponent spacing of the constituents within the particles can be made very small. When the particles are heated to a diffusion temperature, interdiffusion of the diffusible constituents is effected quite rapidly. The powders produced by mechanical alloying are subsequently consolidated into bulk forms by various well known methods such as degassing and hot compaction followed by shaping, e.g., by extrusion, rolling or forging.

The potential for the use of mechanically alloyed powder is considerable. It affords the possibility of improved properties for known materials and the possibility of alloying materials not possible, for example, by conventional melt techniques. Mechanical alloying has been applied to a wide variety of systems containing, e.g., elemental metals, non-metals, intermetallics, compounds, mixed oxides and combinations thereof. The technique has also been used to enable the production of metal systems in which insoluble non-metallics such as refractory oxides, carbides, nitrides, silicides, and the like can be uniformly dispersed throughout the metal particle. In addition, it is possible to interdisperse within the particle larger amounts of alloying ingredients, such as chromium, aluminum and titanium, which have a propensity to oxidize easily. This permits production of mechanically alloyed powder particles containing any of the metals normally difficult to alloy with another metal. Further, it has been applied to produce alloy systems of readily oxidizable components such as aluminum, magnesium, lithium, titanium, and copper.

The present invention is independent of the type of mill used to achieve the mechanically alloyed powder. However, one aspect of the present invention is that the milling to produce the mechanically alloyed powder is carried out in a "gravity-dependent-type" ball mill. Dry, intensive, high energy milling is not restricted to any type of apparatus. Heretofore, however, the principal method of producing mechanically alloyed powders has been in attritors. An attritor is a high energy ball mill in which the charge media are agitated by an impeller located in the media. In the attritor the ball motion is imparted by action of the impeller. Other types of mills in which high intensity milling can be carried out are gravity-dependent-type ball mills, which are rotating mills in which the axis of rotation of the shell of the apparatus is coincidental with a central axis. The axis of a gravity-dependent-type ball mill (GTBM) is typically horizontal but the mill may be inclined even to where the axis approaches a verticle level. The mill shape is typically circular, but it can be other shapes, for example, conical. Ball motion is imparted by a combination of mill shell rotation and gravity. Typically the GTBM's contain lifters, which on rotation of the shell inhibit sliding of the balls along the mill wall. In the GTBM, ball-powder interaction is dependent on the drop height of the balls.

The present method is distinguished from prior use of GTBM apparatus to grind flake, particles of foil, or other particles so as to reduce the particle size, and thereby to reduce the interparticle spacing of dispersoid. The present process differs from prior art grinding in a GTBM, for example, in the type of environment used in the mill, the time to achieve the end purpose and the type of product obtained. In general, to grind the particles in a mill, the milling is carried out in a medium which encourages fracturing of the particles. To mechanically alloy the components of a system, repetitive welding and fracturing of the particles are required. To achieve the appropriate weld/fracture system required for mechanical alloying, the processing is essentially dry and a process control agent may be necessary. Such agents will vary with the materials being processed. The process control agent may also contribute to the composition, e.g., as a precursor of oxides and carbides.

Early experiments appeared to indicate that, while mechanical alloying could be achieved in a GTBM, such mills were not as satisfactory as attritors for producing the mechanically alloyed powder in that it took a considerably longer time to achieve the same processing level. U.S. Pat. No. 4,443,249 discloses an improved process for producing mechanically alloyed powders on a commercial scale. The present invention is a further improvement in producing mechanically alloyed powders, and it may also be carried out in a GTBM.

As indicated above, mechanical alloying has a potential for use with a vast number of systems. The principles disclosed herein are of general application, enabling one to process materials in a GTBM in a practical and commercial manner. However, the description below will be mainly with reference to obtaining mechanically alloyed powders of materials which are readily mechanically weldable. This may occur, for example, in preparing alloy compositions containing metals such as aluminum, magnesium, titanium, copper, lithium, chromium and/or tantalum in sufficient amount for their cold weldability to become a major factor in processing.

The selection of a particular composition will involve the ultimate use of the end product produced from the mechanically alloyed powder. In many instances target properties are proposed by design engineers. Then new materials are sought to meet the target properties. For example, in recent years considerable research efforts have been expanded to develop high strength, light weight, materials which would satisfy the demands of advanced design in aircraft, automotive, naval and electrical industries. It is known to increase the strength of metals by the use of certain additives which will form, for example, oxide dispersion strengthened, age hardened or solution hardened alloys. The use of any particular additives or combinations of them depend on the desired properties. While high strength is a key target property to meet, ultimately it is the combination of properties of the material which determines whether it will be useful for a particular end use. Other properties which are often of interest are ductility, density, corrosion resistance, fracture toughness, fatigue resistant to penetration, machinability and formability.

Composition is only one contributing factor to properties. Mechanical alloying is another, in that it enables the unique combination of materials. Still another determinative factor is the processing level of the mechanically alloyed powder. As indicated above, a characteristic feature of mechanically alloyed powder is the mutual interdispersion of the initial constituents within each particle. In a mechanically alloyed powder, each particle has substantially the same composition as the nominal composition of the alloy. The power processing level is the extent to which the individual constituents are commingled into composite particles and the extent to which the individual constituents are refined in size. The mechanically alloyed powder can be overprocessed as well as underprocessed. An acceptable processing level is the extent of mechanical alloying required in the powder. It is one criterion in determining whether the the resultant powder product is capable of fulfilling its predetermined potential in respect to microstructural, mechanical and physical property requirements. Both underprocessed and overprocessed powders are not readily amenable to conversion to materials with the predetermined desired properties. Underprocessed powder has not been milled sufficiently long for the particles to be uniform or homogeneous with respect to the chemical composition and/or for the process control agent to be thoroughly interspersed in or react with the particles. Also, process control agents may become lost to the alloy composition, e.g. by evaporation, if not utilized at a time when the powders are exposed. In overprocessed powders the morphology of the powder may be sufficiently changed so as to make it more difficult to obtain the desired properties in the consolidated end product. In any event, for practical and economic reasons it is desirable to minimize milling time so long as the processing level achieved is acceptable. Processing beyond complete process control agent utilization may only add redundant cold work to the powder. Determination of the properties of a material can only be made after consolidation and thermomechanical processing of the powders. It will be appreciated that it is costly to learn at such a late stage that powder has not been processed to an acceptable level. Costs, inconvenience, loss of time and availability of equipment increase as the quantities of material increase. Thus, in a ball mill in which large amounts of high quality, high cost materials, such costs can make the materials unacceptable from an economic vantagepoint.

The present method offers a simple, economical way of meeting an acceptable processing level in mechanically alloyed powders.

THE INVENTION

Figure 1C:
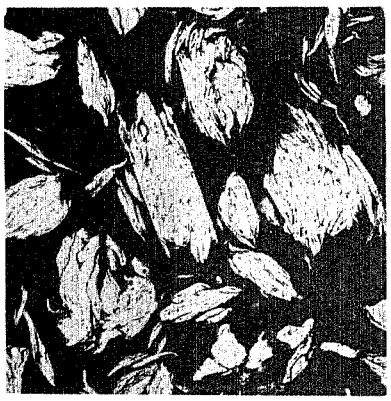
FIGS. 1*a, b, c* and *d* are photomicrographs at 200X magnification of a mechanically alloyed powder having the nominal aluminum and magnesium levels, respectively, of 96% and 4% by weight, and prepared in a GTBM at a 31.5 mill vol. % and a 20:1 ball to powder ratio. Stearic acid in an amount of 1.5% was added and milling was carried out for 7, 12, 16 and 24 hours, respectively.
Figure 1B:
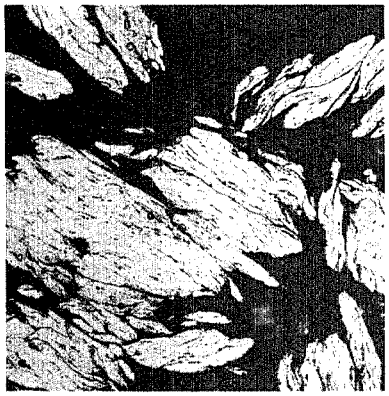
Figure 1D:
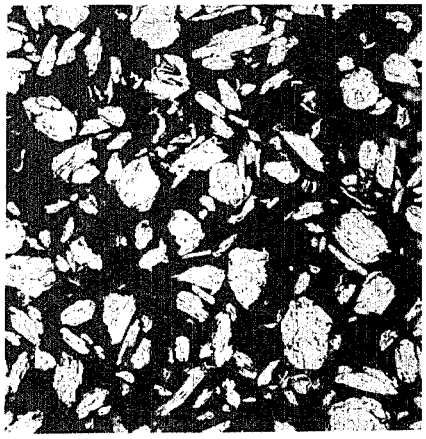

In accordance with the present invention a method is provided for the production on a commercial scale of mechanically alloyed powder product, said powder product being characterized in that it has or can be converted on heating to a substantially uniform chemical composition and microstructure, said powder product being convertible to an end product having predetermined properties and said powder being produced by dry, impact milling particulate components for the powder product in the presence of a predetermined amount of process control agent, said method comprising milling said particulate components in the presence of the process control agent for a sufficient amount of time to produce a powder product having an apparent density of at least about 25% of the fully compacted density of the powder as compacted and extruded; whereby the mill throughput is maximized and an acceptable processing level is obtained for the powder product, said acceptable processing level being one criterion for determining whether the powder product is suitable for producing an end product capable of having the predetermined properties.

While the present invention is not restricted to any type of mill, for example, it can be carried out in an attritor-type or gravity-dependent-type mill, it is particularly useful in a gravity-dependent-type mill since the latter type mills are capable of processing larger feed-throughs.

The apparent density for powder is the weight of a unit volume of loose powder expressed in grams per cubic centimeter determined by a specific method. In the tests reported herein the apparent density was determined by ASTM Test No. B 212-48 (for flowable powder) and No. B 417-64 (for non-free-flowing powder). Fully compacted density of the powder is the density of an essentially non-porous compacted material made from the powder. An essentially non-porous material is one which has no readily descernible residual porosity. We have determined the fully compacted density on material which has been vacuum hot pressed and extruded. Advantageously the apparent density is above 30%, and preferably at least 35% of the fully compacted density. Although economics dictate that the milling time be minimized, suitably the apparent density is no greater than about 65% of the fully compacted density, and preferably it may range up to about 55%. Typically the apparent density is in the range of about 30% to about 60%, and preferably above about 30% up to about 50% of the fully compacted density. Below about 20% the powder product is likely to be underprocessed. Above about 65% there is no value in further milling and further milling may be detrimental in that the optimum properties cannot be readily obtained. in an Al-4 Mg type alloy, for example, the fully compacted density was determined to be about 2.66 g/cm$^3$, and for achieving optimum and reproducible properties in the end product the apparent density is suitably at least about 0.8 g/cm$^3$, advantageously 0.9 g/cm$^3$ and preferably in the range of about 1 to about 1.3 g/cm$^3$.

COMPOSITION OF POWDER

The present process applies generally to materials that can be produced as mechanically alloyed powders. Such powders may range from simple binary systems to complex alloys, such systems not being limited by considerations imposed. They may or may not include a refractory dispersoid. They may be dispersion strengthened or composite systems. All components of the system are or are capable of being uniformly dispersed with a suitable heat treatment. In general, the systems contain at least one metal, which may be a noble or a base metal. The metal may be present in elemental form, as an intermetallic, as a compound or part of a compound. Examples of alloy systems amenable to mechanical alloying techniques are described in detail in the aforementioned U.S. Patents, which are incorporated herein by reference. The patents describe, for example, many nickel-, iron-, cobalt-, copper-, precious metal-, titanium- and aluminum-base alloy systems. Examples of the more complex alloy systems that can be produced by the invention include well known heat resistant alloys such as alloys based on nickel-chromium, cobalt-chromium, iron-chromium systems containing one or more of such alloying additions as molybdenum, manganese, tungsten, niobium, tantalum, aluminum, titanium, zinc, cerium and the like.

As indicated above, the present system is particularly useful for producing mechanically alloyed powders of readily mechanically weldable materials, for example, aluminum, titanium, magnesium, copper, tantalum, niobium, lithium containing materials. Such materials may be alloys, e.g., with each other and/or containing one or more of such components comprising lithium, calcium, boron, yttrium, zinc, silicon, nickel, cobalt, chromium, vanadium, cerium and other rare earth metals, beryllium, manganese, tin, iron and/or zirconium. Constituents may be added in their elemental form or, to avoid contamination from atmospheric exposure, as master alloy or metal compound additions wherein the more reactive alloying addition is diluted or compounded with a less reactive metal such as nickel, iron, cobalt, etc. Certain of the alloying non-metals, such as carbon, silicon, boron, and the like, may be employed in the powder form or added as master alloys diluted or compounded with less reactive metals. Thus, stating it broadly, rather complex alloys, not limited by considerations imposed by the more conventional melting and casting techniques, can be produced in accordance with the invention over a broad spectrum of compositions, based on systems of the iron, nickel, cobalt, columbium, tungsten, aluminum, magnesium, titanium, tantalum, copper, molybdenum, chromium or precious metals of the platinum group.

The simple or more complex alloys can be produced with uniform dispersions of hard phases, such as oxides, carbides, nitrides, borides and the like. For example, the dispersion may be oxides, carbides, nitrides, borides of such elements as thorium, zirconium, hafnium, titanium, silicon, boron, aluminum, yttrium, cerium and other rare earth metals, uranium, magnesium, calcium, beryllium, tantalum, etc.

Compositions produced may include hard phases over a broad range so long as a sufficiently ductile component is present to provide a host matrix for the hard phase of dispersoid. Where only dispersion strengthening or wrought compositions are desired, such as in high temperature alloys, the amount of dispersoid may range from a small but effected amount for increased strength, e.g., 0.15% by volume or even less (e.g., 0.1%) up to 25% by volume or more, advantageously from about 0.1% to about 5% or 10% by volume. In composite materials the hard phases may range to a considerably higher percentage of the system even over 50 or 60 volume %.

As indicated above, the processing of the present invention is not limited to any particular system. In respect to the readily mechanically weldable alloys, e.g. of the type aluminum-, magnesium-, titanium-, copper-, lithium- and tantalum-base alloys, examples can be found by those skilled in the art in well-known metals handbooks. For example, for aluminum alloys such alloys would be of the 1000 through 8000 series and aluminum-lithium alloys.

In one example of an alloy comprising essentially aluminum, magnesium, carbon and oxygen, the nominal magnesium content is about 4%, the carbon content ranges from about 1% to about 1.3% and oxygen is present in a small amount, viz. less than 1%.

In respect to alloys of the iron-, nickel-, cobalt-base type, typical alloys may comprise by weight up to about 65% chromium, e.g., about 5% to 30% chromium, up to about 10% aluminum, e.g., about 0.1% to 9.0% aluminum, up to about 10% titanium, e.g., about 0.1% to 9.0% titanium, up to about 40% molybdenum, up to about 40% tungsten, up to about 30% niobium, up to about 30% tantalum, up to about 2% vanadium, up to about 15% manganese, up to about 2% carbon, up to about 3% silicon, up to about 1% boron, up to about 2% zirconium, up to about 0.5% magnesium and the balance at least one element selected from a group consisting of essentially of iron group metals (iron, nickel, cobalt) and copper with the sum of the iron, nickel, cobalt and copper being at least 25%, with or without dispersion strengthening constituents such as yttria or alumina, ranging in amounts from about 0.1% to 10% by volume of the total composition.

As stated hereinbefore, the metal systems of limited solubility that can be formulated in accordance with the invention may include copper-iron with the copper ranging from about 1% to 95%; copper-tungsten with the copper ranging from about 5% to 98% and the balance substantially tungsten; chromium-copper with the chromium ranging from about 0.1% to 95% and the balance substantially copper and the like. Where the system of limited solubility is a copper-base material, the second element, e.g., tungsten, chromium and the like, may be employed as dispersion strengtheners.

In producing mechanically alloyed metal particles from the broad range of materials mentioned hereinbefore, the starting particle size of the starting metals may range from about over 1 micrometers up to as high as 1000 micrometers. It is advantageous not to use too fine a particle size, particularly where reactive metals are involved. Therefore, it is preferred that the starting particle size of the metals range from about 3 micrometers up to about 250 micrometers.

Examples of alloy ranges, in weight percent, can be found in Table I.

TABLE I

| Metal Component | Nominal Ranges - Weight % Sample A | B | C | D | E | F | G | H |
|---|---|---|---|---|---|---|---|---|
| Aluminum | Bal. | 0–12 | 0–8 | 0–2 | 0–15 | 0–40 | 0–15 | 0–50 |
| Magnesium | 0–10 | Bal. | 0–5 | 0–2 | 0–3 | 0–40 | 0–30 | 0–50 |
| Titanium | 0–8 | 0–8 | Bal. | 0–2 | 0–3 | 0–40 | 0–40 | 0–8 |
| Tantalum | 0–6 | 0–6 | 0–5 | Bal. | 0–3 | 0–6 | 0–6 | 0–6 |
| Copper | 0–10 | 0–6 | 0–5 | 0–2 | Bal. | 0–40 | 0–40 | 0–10 |
| Nickel | 0–50 | 0–6 | 0–5 | 0–2 | 0–40 | Bal. | 0–40 | 0–40 |
| Cobalt | 0–50 | 0–6 | 0–5 | 0–2 | 0–3 | 0–40 | Bal. | 0–40 |
| Iron | 0–12 | 0–6 | 0–6 | 0–2 | 0–10 | 0–50 | 0–50 | Bal. |
| Lithium | 0–5 | 0–6 | 0–6 | 0–2 | 0–50 | 0–6 | 0–40 | 0–5 |
| Chromium | 0–10 | 0–6 | 0–6 | 0–2 | 0–10 | 0–40 | 0–40 | 0–40 |
| Zirconium | 0–8 | 0–6 | 0–6 | 0–2 | 0–8 | 0–15 | 0–50 | 0–20 |
| Carbon | 0–5 | 0–5 | 0–5 | 0–2 | 0–2 | 0–5 | 0–5 | 0–20 |
| Lead | 0–6 | 0–6 | 0–6 | 0–2 | 0–5 | 0–10 | 0–6 | 0–10 |
| Tungsten | 0–8 | 0–6 | 0–6 | 0–2 | 0–40 | 0–10 | 0–30 | 0–40 |
| Molybdenum | 0–10 | 0–6 | 0–6 | 0–2 | 0–2 | 0–40 | 0–40 | 0–40 |
| Manganese | 0–10 | 0–6 | 0–12 | 0–2 | 0–5 | 0–15 | 0–15 | 0–30 |
| Silicon | 0–20 | 0–5 | 0–5 | 0–2 | 0–5 | 0–15 | 0–5 | 0–50 |
| Hafnium | 0–8 | 0–5 | 0–6 | 0–2 | 0–2 | 0–10 | 0–6 | 0–10 |
| Vanadium | 0–12 | 0–10 | 0–20 | 0–2 | 0–5 | 0–10 | 0–10 | 0–20 |
| Niobium | 0–8 | 0–8 | 0–6 | 0–2 | 0–5 | 0–20 | 0–20 | 0–20 |
| Platinum Group Metals | 0–10 | 0–10 | 0–6 | 0–2 | 0–2 | 0–10 | 0–10 | 0–20 |
| Tin | 0–8 | 0–8 | 0–6 | 0–2 | 0–8 | 0–10 | 0–10 | 0–10 |
| Rare Earth Metals | 0–10 | 0–10 | 0–10 | 0–10 | 0–10 | 0–40 | 0–10 | 0–10 |
| Zinc | 0–10 | 0–10 | 0–6 | 0–2 | 0–50 | 0–10 | 0–10 | 0–50 |
| Boron | 0–10 | 0–10 | 0–10 | 0–2 | 0–10 | 0–10 | 0–10 | 0–10 |
| Beryllium | 0–5 | 0–5 | | | 0–5 | | | |
| Hard Phases: | | | | | | | | |
| (a) Dispersoid*(1) | 0–15 | 0–15 | 0–15 | 0–15 | 0–15 | 0–15 | 0–15 | 0–15 |
| (b) Composites(2) | 0–50 | 0–50 | 0–50 | 0–50 | 0–50 | 0–50 | 0–50 | $–50 |

*In volume %
(1) e.g. oxides and carbides such as $Y_2O_3$, $Al_2O_3$, MgO, $Al_4C_3$
(2) e.g. carbides such as SiC, $B_4C$ The ranges of components in Table I include the possibility of forming ordered compounds. It will be appreciated that in specific alloys the components will add up to 100%. Also, it will be appreciated that composition should be selected with end use contemplated. For example, in any alloy system of the A type in Table I, generally, for good ductility the oxygen level should be less than 1%. For good high temperature stability the carbon content should be less than 2%.

PROCESSING

During processing in the mill, the chemical constituents of the powder product are interdispersed, and the uniformity and energy content of the powder product will depend on the processing conditions. In general, important to powder processing are the size of the mill, the size of the balls, the ball mass to powder mass ratio, the mill charge volume, the mill speed, the process control agents (including the processing atmosphere) and processing time. Even the materials of construction of the mills and balls may have a bearing on the powder product.

The feed materials to the mill, may be fed directly to the mill or may be preblended and/or may be prealloyed. In one embodiment of the invention the feed is charged to as GTBM which, for example, has a diameter ranging from about 1 foot to about 8 feet (and greater). Economic factors may mitigate against scale-up of such a mill to greater than 8 feet in diameter, and the length may vary from about 1 foot to about 10 feet (and greater) depending on the demand for material. The lining of the mill is material which during milling should not crush or spall, or otherwise contaminate the powder. An alloy steel would be suitable. The balls charged to the mill are preferably steel, e.g. 52100 steel. The volume of balls charged to the mill is typically about 15% up to about 45%, i.e., the balls will occupy about 15 to 45% of the volume of the mill. Preferably, the ball charge to the mill will be about 25 to 40 volume %, e.g. about 35 volume %. In a GTBM at above about 45 volume % the balls will occupy too much of the volume of the mill and this will affect the average drop height of the balls adversely. Below about 15 volume %, the number of collisions is reduced excessively, mill wear will be high and with only a small production of powder. In a GTBM the ratio of mill diameter to initial ball diameter is from about 24 to about 200/1, with about 150/1 recommended for commercial processing. The initial ball diameter may suitably range from about 3/16" to about ¾", and is advantageously about ⅜" to about ¾", e.g. about ½". In a GTBM if the ball diameter is lowered, e.g. below ⅜", the collision energy is too low to get efficient mechanical alloying, and if the ball diameter is too large, e.g. above about ¾", the number of collisions per unit time will decrease. As a result, the mechanical alloying rate decreases and a lower uniformity of processing of the powder may also result. Advantageously, balls having an initial diameter of ½" are used in 6' diameter GTBM's. Reference is made to the impact agents as "balls" and in general these agents are spherical. However, they may be any shape. It is understood that the shape of the balls and the size may change in use, and that additional balls may be added during processing, e.g., to maintain the mill charge volume.

The ball mass/powder mass (B/P) ratio in the mill is in the range of about 40/1 to about 5/1. A B/P ratio of about 20/1 has been found satisfactory. Above about 40/1 there is more possibility of contamination. Because there tend to be more ball-to-ball collisions, there is a higher rate of ball wear. At the lower ball to powder ratios, e.g. below about 5/1, processing is slow.

The present process is carried out advantageously in a GTBM at about 65% to about 90% of the critical rotational speed (Nc) of the mill. The critical rotational speed is the speed at which the balls are pinned to the inner circumferential surface of the GTBM due to centrifugal force. The drop height of the balls is much less effective below about 65% Nc.

The dry, impact milling is typically carried out in a GTBM as a batch process. The powder is collected, screened to size, consolidated, and the consolidated material is subjected to various thermomechanical processing steps which might include hot and/or cold working steps, and/or heat treatments, aging treatments, grain coarsening, etc.

It is noted that attritors may range in size to a capacity of about 200 lbs. of powder. A GTBM may range in size to those with a capacity for processing up to, for example, about 3000–4000 lbs. in a batch. It will be appreciated that the opportunity afforded by producing large quantities of mechanically alloyed powders to a readily ascertainable acceptable processing level offers attractive commercial possibilities not possible with presently available attritors.

Milling is carried out until the powder has an apparent density of at least about 25% of the fully compacted density of the powder product. At this stage of processing in the processing the powder is not only mechanically alloyed, but also it has suitable packing qualities and is further characterized in that the powder can be converted to consolidated products having predetermined desired properties, e.g., in respect to strength, ductility, chemical homogeneity and microstructure. Furthermore, the apparent density of the powder can be determined easily by standard tests, e.g., ASTM Test Nos. B 212-48 and B 417-64 depending upon whether the powder is flowable (B 212-48) or non-free-flowing (B 417-64).

PROCESS CONTROL AGENTS

The mechanical alloyed powder is prepared by subjecting the charge material to dry, impact milling in the presence of a grinding media, e.g. balls, and a process control agent. The process control agent is one which will enable the charge material to repeatedly fracture and weld during milling so as to create new dense particles containing fragments of the initial powder materials intimately associated and uniformly dispersed. The process control agent may consist of one or more substances which may be in the mill environment and/or present as part of the feed material. The process control agents may become a component of the powder product. Thus in determining the amount of processing agent to be used both its weld-retarding property and desired contribution (if any) to the end product must be considered.

In order to control processing and the composition of the material in the mill, the milling is carried out in a controlled atmosphere, thereby facilitating, for example, oxygen control. Examples of controlled environment are inert gas which may contain free oxygen. A component of the mill atmosphere may become part of the powder product, e.g. oxygen in the mill atmosphere may contribute to all or part of the oxide dispersoid in the alloy.

For nickel- and cobalt-base alloys, the process control agent may be the controlled atmosphere in the mill, depending on the alloy composition. For example, nickel-base alloys are processed in an $O_2$-containing atmosphere, e.g. $O_2$ or air, carried in a carrier gas such as $N_2$ or Ar. An appropriate environment containing free oxygen is, for example, about 0.22% to 4.0% oxygen in $N_2$. Cobalt-base alloys can be processed in an environment similar to that used for nickel-base alloys. For iron-base alloys the controlled atmosphere should be suitably inert. In general, it is non-oxidizing, and for some iron-base alloys the nitrogen should be substantially excluded from the atmosphere. Advantageously, an inert atmosphere, for example, an argon atmosphere is used. For copper-base alloys the atmosphere is an inert gas such as argon, helium, or nitrogen with small additions of air or oxygen to insure a balance between cold welding and fracture.

In milling readily mechanically weldable charge materials comprising metals such as aluminum, magnesium, lithium and titanium, milling is typically done under an argon or nitrogen blanket. The process control agent is present in a weld-controlling amount and in one aspect of this invention comprises an oxygen- and/or carbon-contributing compound. The process control agent may comprise, e.g., graphite and/or a volatilizable amount of an oxygen-containing hydrocarbon such as organic acids, alcohols, aldehydes and ethers. Examples of suitable process control agents for alloys of this type are methanol, stearic acid, and derivatives thereof, e.g., octadecanoamide. In processing of the highly oxidizable alloys it has been found particularly desirable to add to the mill initially with the charge material the amount of process control agent needed to obtain the material of desired composition.

Typically, the process control agent may be present in an amount ranging from about 0.01% to about 5%, based on the weight of the particulate components of the powder product. In the event the process control agent comprises a non-gaseous component, e.g. stearic acid or a derivative thereof, the non-gaseous component may be present in an amount ranging from about 0.1% to about 5%.

The following illustrative examples are given to afford those skilled in the art a better appreciation of the invention.

EXAMPLE I

Samples of powder having a composition designed to produce a powder product having the nominal aluminum and magnesium levels of 96% and 4% by weight, respectively, are charged to a 1.5 m (5 ft.) diameter×0.3 m (1 ft.) long GTBM. The mill rotates about a substantially horizontal central axis and is charged with 3 mm (0.5 in.) diameter 52100 balls. The samples are processed to powder products in the mill under various conditions, viz. ball to powder weight ratios (B/P), duration of processing, mill speeds and amounts, and mode of stearic acid (SA) addition. The conditions of each run and various data such as apparent density, amounts of oxygen and carbon absorbed and screen analysis are summarized in TABLE II. Determination of apparent density is by ASTM Test No. B 212-48 for free-flowing powder and ASTM Test No. B 417-64 for non-free flowing powder. Results obtained on a mechanically alloyed sample prepared in an attritor are also shown in TABLE II. The target properties for samples having 1.5% stearic acid addition are TYS=55 ksi, UTS=65 ksi and El=5%.

TABLE II

| Processing Parameters | | | | | Powder Properties | | | | | | | | | |
|---|---|---|---|---|---|---|---|---|---|---|---|---|---|---|
| | | | | | | | | | Screen Analysis (%) | | | | | |
| Run No. | B/P | Speed % Nc | % SA | Run Time (hr) | Apparent Density (g/cm³) | Chemistry (wt. %) O | C | Fe | +80 | −80 + 100 | −100 + 140 | −140 + 200 | −200 + 325 | −325 |
| 1 | 20/1 | 65 | 0.5 | 1 | | 0.63 | 0.35 | | | | | | | |
| | | | | 7.25 | | 0.69 | 0.42 | | | | | | | |
| | | | | 11.5 | 1.24 | 0.50 | 0.45 | | 83.2 | 10.2 | 4.6 | 1.4 | 0.4 | 0.2 |
| 2 | 20/1 | 65 | 1.0 | 4 | | 1.38 | 0.58 | | | | | | | |
| | | | | 8 | | 1.05 | 0.60 | | | | | | | |
| | | | | 12 | | 0.58 | 0.71 | | | | | | | |
| | | | | 16 | | 0.39 | 0.67 | | | | | | | |
| | | | | 20 | | 0.46 | 0.62 | | | | | | | |
| | | | | 24 | 1.02 | 0.38 | 0.71 | | 7 | 5 | 8.6 | 12.6 | 29.6 | 3.48 |
| 3 | 20/1 | 65 | 1.5 | 4 | | 1.38 | 0.76 | | | | | | | |
| | | | | 7.25 | | 2.03 | 0.89 | | | | | | | |

TABLE II-continued

| Processing Parameters | | | | | Powder Properties | | | | | | | | | | |
|---|---|---|---|---|---|---|---|---|---|---|---|---|---|---|---|
| | | | | | | | | | Screen Analysis (%) | | | | | | |
| Run No. | B/P | Speed % Nc | % SA | Run Time (hr) | Apparent Density (g/cm³) | Chemistry (wt. %) O | C | Fe | +80 | −80 + 100 | −100 + 140 | −140 + 200 | −200 + 325 | −325 |
| | | | | 12 | | 1.46 | 0.96 | | | | | | | |
| | | | | 16 | | 0.89 | 1.04 | | | | | | | |
| | | | | 20 | | 0.64 | 1.11 | | | | | | | |
| | | | | 24 | 1.01 | 0.57 | 1.16 | | 2.8 | 1.6 | 3.4 | 7 | 20.4 | 62.4 |
| 4 | 20/1 | 65 | 1.5 | 4 | | 1.23 | 0.48 | | | | | | | |
| | | | | 8 | | 0.69 | 0.53 | | | | | | | |
| | | | | 12 | | 1.02 | 0.74 | | | | | | | |
| | | | | 16 | | 1.54 | 1.05 | | | | | | | |
| | | | | 20 | | 1.44 | 1.01 | | | | | | | |
| | | | | 24 | 0.69 | 0.81 | 0.91 | | 2.4 | 3.6 | 8.8 | 16.6 | 25.2 | 42.4 |
| 5 | 15/1 | 65 | 1.5 | 16 | | | | | | | | | | |
| | | | | 24 | | | | | | | | | | |
| | | | | 32 | 0.972 | | | | | | | | | |
| | | | | 36 | | | | | | | | | | |
| | | | | 40 | 1.056 | 0.48 | 1.06 | 0.03 | 2.4 | 1.8 | 2.6 | 4.6 | 9.4 | 76.4 |
| 6 | 15/1 | 65 | 1.5 | 32 | 1.028 | 0.52 | 1.17 | 0.02 | 1.8 | 1.0 | 2.4 | 4.0 | 10.2 | 77.2 |
| 7 | 15/1 | 65 | 1.5 | 3 | 0.33 | 1.93 | 0.71 | | | | | | | |
| | | | | 6 | 0.39 | 0.76 | 0.32 | | | | | | | |
| | | | | 14 | | 1.79 | 0.96 | | | | | | | |
| | | | | 22 | | 1.06 | 0.98 | | | | | | | |
| | | | | 29.75 | | 0.87 | 0.99 | | | | | | | |
| | | | | 38 | 1.02 | 0.76 | 1.11 | | | | | | | |
| | | | | 46 | 1.05 | 0.76 | 1.11 | | 2.0 | 1.0 | 2.2 | 3.2 | 5.8 | 82.4 |
| 8 | 15/1 | 65 | 1.5 | 36 | 1.04 | 0.59 | 1.07 | | 2.2 | 1.2 | 2.6 | 4.2 | 7.8 | 78 |
| 9 | 20/1 | 65 | 1.5 | 2.5 | | | | | | | | | | |
| | | | | 5 | 0.4 | | | | | | | | | |
| | | | | 13 | | | | | | | | | | |
| | | | | 21 | | | | | | | | | | |
| | | | | 24 | | | | | | | | | | |
| | | | | 28 | 0.97 | | | | | | | | | |
| | | | | 36 | 1.07 | 0.55 | 1.13 | | 2.2 | 1.2 | 2.6 | 3.4 | 6 | 79.6 |
| 10 | 20/1 | 65 | 1.5 | 28 | 1.03 | 0.52 | 1.15 | | 2.8 | 2.0 | 4.0 | 5.6 | 11.2 | 70.6 |
| 11 | 30/1 | 65 | 1.5 | 15 | 0.76 | 0.97 | 1.04 | | 1.6 | 1.2 | 3.4 | 8.4 | 15.0 | 69.2 |
| 12 | 20/1 | 72 | 1.5 | 4.25 | | | | | | | | | | |
| | | | | 8 | | | | | | | | | | |
| | | | | 20 | | | | | | | | | | |
| | | | | 27 | 1.02 | 0.64 | 1.14 | | 2.8 | 1.2 | 2.4 | 3.8 | 8.8 | 79 |
| 13 | 20/1 | 72 | 1.5 | 21 | 0.98 | 0.61 | 1.09 | | 3.8 | 1.8 | 3.2 | 5.2 | 14.6 | 64.4 |
| 14 | 20/1 | 80 | 1.5 | 4 | | | | | | | | | | |
| | | | | 8 | | | | | | | | | | |
| | | | | 12 | | | | | | | | | | |
| | | | | 17 | | | | | | | | | | |
| | | | | 22 | 1.0 | 0.58 | 1.16 | | 2.2 | 1.2 | 2.0 | 3.8 | 10.6 | 76.2 |
| 15 | 20/1 | 80 | 1.5 | 18 | 0.97 | 0.55 | 1.14 | | 6.8 | 3.0 | 4.6 | 7.4 | 17.0 | 57.2 |
| 16 | 20/1 | 86 | 1.5 | 4 | | | | | | | | | | |
| | | | | 8 | | | | | | | | | | |
| | | | | 12 | | | | | | | | | | |
| | | | | 16 | | | | | | | | | | |
| | | | | 19.5 | 1.01 | 0.53 | 1.22 | | 5.4 | 2.6 | 4.8 | 6.2 | 15.8 | 61.4 |
| 17 | 20/1 | 86 | 1.5 | 16.5 | 0.95 | 0.57 | 1.36 | | 5.2 | 2.6 | 4.4 | 7.6 | 17.6 | 59 |
| A | Attrited | | 1.5 | 9 | 1.08 | 0.78 | 1.13 | | 2.2 | 1.0 | 2.0 | 4.6 | 10.4 | 76.8 |

Reference to TABLE II shows that the carbon content of the powder generally increases with milling time and oxygen content decreases with milling time. For the 1.5% SA alloy, processing is complete when the carbon content of the alloy is greater than about 1.1 weight % and the oxygen content is below about 1%. It will be appreciated that chemical analysis for carbon and oxygen will vary depending on the technique used. The data show that when the apparent density of the powder product reaches about 1 g/cm³ then the desired carbon level has also been reached. It was observed that the powder product of Runs 1 and 2 were free-flowing, while the powder product of Runs 3, 4 and 11 were non-free flowing. The attrited powder of Run A was non-free flowing.

Powder could be processed in the ball mill at all levels of SA addition, viz. 0.5%, 1.0% and 1.5%. In Run 11 having a B/P 30/1, milling for 15 hours produced a powder with oxygen content at the high end of the permissible range, viz. 0.97%, and only 1.04% carbon, and a low apparent density of 0.76 g/cm³. The powder was still flaky and less powder was needed to fill a vacuum hot press die than powders which are processed to an apparent density of at least 1.

Figure 1A:
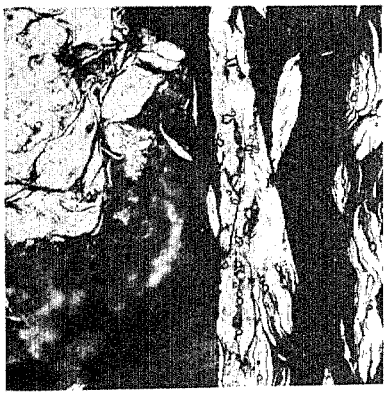
Figure 2:
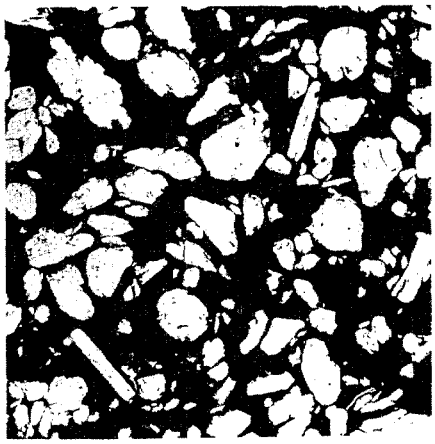
FIG. 2 is a photomicrograph at 200X magnification of a mechanically alloyed powder having essentially the same aluminum-magnesium composition as that of FIG. 1*d*. However, the powder was processed in an attritor.

Metallographic studies of the powders produced show that the powder transforms during processing from flaky to globular. FIGS. 1*a*, *b*, *c* and *d* show a processing time series for a group of alloys in which 1.5% SA is added. The photomicrographs show the progress toward a globular morphology after 7, 12, 16 and 24 hours of milling time. At 24 hours milling duration, a predominant amount (i.e., more than 50%) of the powder particles in globular, and the powder optically appears to be essentially chemically and physically homogenous. At 24 hours milling the powder has an apparent density of about 1 g/cm³ or 38% of the fully compacted density. As will be shown in EXAMPLE II, this powder product can be processed to consolidated material with the desired target properties. Furthermore, the powder product will pack appropriately in a compaction die, e.g. in vacuum hot pressing equipment.

EXAMPLE II

This example shows tensile and notch properties of extrusion billets made from powder drained at the end of various runs shown in TABLE II. To prepare the samples the powder is drained, degassed and compacted followed by extrusion.

Consolidation conditions, tensile properties and notch properties are summarized in TABLE III. Target properties for the consolidated material were shown in EXAMPLE I.

The data in TABLES II and III indicate that increased powder loadings from 20 to 15/1 B/P, lengthens the processing time necessary to achieve target tensile properties. For example, to achieve similar tensile properties for powder of Run No. 12 at 20/1 B/P requires 27 hours of processing, while Run No. 7 at 15/1 B/P requires 46 hours of processing.

It was found with respect to processing in the GTBM that generally it is desirable to add the process control agent such as stearic acid in toto initially since sequential additions tended to require longer processing time in order to obtain appropriate powder.

The effect of mill rotational speed on processing efficiency in the GTBM can be seen in TABLE IV. At constant 20/1 B/P and 31.5 mill vol. % ball loading, increasing mill speed from 65% (21 rpm) to 86% (29.5 rpm) of the critical speed not only, reduces the time for equivalent number of rotations, but also the required number of rotations is decreased. In other words increasing the mill rotational speeds increase processing efficiency.

In general, the lower the apparent density of the powder product the higher the oxygen content and the more "flaky" the powder. The more "flaky" powder is less apt to form a satisfactory consolidated product. For example, powder produced in Run 11 of TABLE II, which had an apparent density of 0.76 (or about 29% of the fully compacted density) not only packed more poorly but also was found to have inferior strength compared to powders processed to a higher apparent density. To optimize strength, the apparent density, preferably, is about 35% of the fully compacted density.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

TABLE III

| | TYS | | CYS | | UTS | | El | RA | Modulus | | Ratio Notched/Unnotched | |
|---|---|---|---|---|---|---|---|---|---|---|---|---|
| Heat* | MPa | (ksi) | MPa | (ksi) | MPa | (ksi) | % | % | GPa | ($10^6$ psi) | Yield | Ultimate |
| 1 | 359 | (52) | 359 | (52) | 455 | (56) | 17 | 42 | 70.3 | (10.2) | 1.64 | 1.51 |
| 2 | 441 | (64) | 441 | (64) | 462 | (67) | 9 | 29 | 75.9 | (11.0) | 1.62 | 1.54 |
| 3 | 448 | (65) | 462 | (67) | 476 | (69) | 19 | 29 | 76.6 | (11.1) | 1.57 | 1.48 |
| 4 | 545 | (79) | 566 | (82) | 593 | (86) | 6 | 29 | 76.6 | (11.1) | 1.50 | 1.36 |
| 5 | 503 | (73) | 531 | (77) | 531 | (77) | 7 | 23 | 75.9 | (11.0) | 1.45 | 1.38 |
| 6 | 490 | (71) | 497 | (72) | 517 | (75) | 9 | 26 | 74.5 | (10.8) | 1.46 | 1.38 |
| 7 | 552 | (80) | 579 | (84) | 586 | (85) | 7 | 25 | 78.6 | (11.4) | 1.44 | 1.35 |
| 8 | 497 | (72) | 510 | (74) | 524 | (76) | 8 | 23 | 76.6 | (11.1) | 1.47 | 1.40 |
| 9 | 538 | (78) | 545 | (79) | 559 | (81) | 7 | 19 | 73.8 | (10.7) | 1.44 | 1.38 |
| 10 | 531 | (77) | 545 | (79) | 566 | (82) | 1.5 | 21 | 76.6 | (11.1) | 1.41 | 1.34 |
| 12 | 524 | (76) | 538 | (78) | 552 | (80) | 6 | 27 | 75.2 | (10.9) | 1.44 | 1.38 |
| 13 | 503 | (73) | 510 | (74) | 531 | (77) | 6 | 25 | 74.5 | (10.8) | 1.44 | 1.37 |
| 14 | 517 | (75) | 517 | (75) | 538 | (78) | 7 | 28 | 76.6 | (11.1) | 1.42 | 1.36 |
| 15 | 517 | (75) | 524 | (76) | 545 | (79) | 7 | 25 | 78.6 | (11.4) | 1.43 | 1.35 |
| 16 | 531 | (77) | 531 | (77) | 552 | (80) | 7 | 26 | 79.3 | (11.5) | 1.41 | 1.34 |
| 17 | 524 | (76) | 531 | (77) | 552 | (80) | 7 | 25 | 77.2 | (11.2) | 1.40 | 1.33 |
| A | 531 | (77) | 559 | (81) | 552 | (80) | 8 | 29 | 73.8 | (10.7) | 1.47 | 1.41 |

TYS = Tensile yield stress at 0.2% offset
CYS = Compressive yield stress at 0.2% offset
UTS = Ultimate tensile strength
*Consolidation Conditions:
Heats 1 thru 4 Degassed and compacted 493° C. (920° F.)
Extruded 371° C. (700 ° F.) 6.4/1
Heats 5 thru 17 Degassed and compacted 493° C. (920° F.)
and A Extruded 399° F.) 9/1

TABLE IV

| | Mill Speed | | Time of | Total Mill | YS | | % |
|---|---|---|---|---|---|---|---|
| Heat | RPM | % Nc | Run (hr) | Rotations | MPa | (ksi) | El |
| 3 | 21 | 65 | 24 | 30240 | 448 | (65) | 9 |
| 12 | 24.5 | 72 | 27 | 39690 | 524 | (76) | 6 |
| 14 | 27.5 | 80 | 22 | 36300 | 517 | (75) | 7 |
| 16 | 29.5 | 86 | 19.5 | 34515 | 531 | (77) | 7 |

The embodiments of the invention in which an exclusive property or privilege is claimed as defined as follows:

1. A method for the production on a commercial scale of a mechanically alloyed powder product, said powder product being characterized in that it has or can be converted on heating to a substantially uniform chemical composition and microstructure, said powder product being convertible to an end product having predetermined properties and said powder being produced by dry, impact milling particulate components for the powder product in the presence of a predetermined amount of process control agent, said method comprising determining the duration of time to produce a powder product having an apparent density of at least about 25% of the fully compacted density of the powder as compacted and extruded, the apparent density being determined according to ASTM Test No. B 212-48 (for flowable powder) or No. B 417-64 (for non-free-flowing powder), using said determination of the duration of time to obtain said apparent density in determining the duration of time for impact milling of the particulate components; whereby the mill throughput is maximized and an acceptable processing level is obtained for the powder product, said acceptable processing level being one criterion for determining whether the powder product is suitable for producing an end product capable of having the predetermined properties.

2. A method according to claim 1, wherein the impact milling is carried out in an impact mill selected from an impeller-type or a gravity-dependent-type ball mill.

3. A method according to claim 1, wherein the milling is carried out to produce a powder product having an apparent density of above 30% of the fully compacted density of the powder product.

4. A method according to claim 1, wherein the milling is carried out to produce a powder product having an apparent density of at least 35% of the fully compacted density of the powder product.

5. A method according to claim 1, wherein the milling is carried out to produce a powder product having an apparent density of no greater than 65% of the fully compacted density of the powder product.

6. A method according to claim 1, wherein the milling is carried out to produce a powder product having an apparent density in the range of about 30% to about 60% of the fully compacted density of the powder product.

7. A method according to claim 1, wherein the milling is carried out to produce a powder product having an apparent density in the range of above 30% up to about 50% of the fully compacted density of the powder product.

8. A method according to claim 1, wherein the mechanically alloyed powder is an aluminum-base alloy containing nominally, by weight, about 4% magnesium, about 1% to about 1.3% carbon and oxygen is present in an amount ranging up to less than 1% and having a fully compacted density of about 2.7 g/cm$^3$, and the milling is continued to produce a powder product having an apparent density of at least about 0.8 g/cm$^3$.

9. A method according to claim 8, wherein the apparent density of the powder product is at least about 0.9 g/cm$^3$.

10. A method according to claim 8, wherein the apparent density of the powder product is in the range of about 1 g/cm$^3$ to about 1.3 g/cm$^3$.

11. A method according to claim 1, wherein the process control agent present comprises a weld-controlling amount.

12. A method according to claim 1, wherein the process control agent provides components of the powder product.

13. A method according to claim 1, wherein said process control agent is present in an amount ranging from about 0.01% to about 5% based on the weight of the particulate components.

14. A method according to claim 13, wherein the process control agent comprises stearic acid.

15. A method according to claim 8, wherein the process control agent comprises stearic acid and the stearic acid is present in an amount ranging from about 0.5% to about 1.5% based on the weight of the particulate components.

16. A method according to claim 1, wherein the mechanically alloyed powder product is comprised of readily mechanically weldable components.

17. A method according to claim 16, wherein the mechanically alloyed powder product is comprised of a member selected from the group aluminum, magnesium, titanium, copper, and lithium.

18. A method according to claim 1, wherein the mechanically alloyed powder product is selected from the group nickel-, cobalt- and iron-base alloys.

19. A method according to claim 16, wherein the mechanically alloyed powder product comprises aluminum.

20. A method according to claim 19. wherein the mechanically alloyed powder product viewed at a magnification of 200X is predominantly globular.

21. A method according to claim 1, wherein the process control agent comprises a predetermined amount of non-gaseous additive.

22. A method according to claim 21, wherein the predetermined amount of non-gaseous process control agent is added at the initial stage of milling.

23. A method according to claim 21, wherein the predetermined amount of non-gaseous component of the process control agent is added sequentially during milling.

24. A method according to claim 15 wherein the stearic acid is present in an amount of about 1.5% of the particulate components and the carbon content of the powder product is at least about 1.1%.

25. A method according to claim 24, wherein the oxygen level of the powder product is less than 1%.

26. A method for the production on a commercial scale of a mechanically alloyed powder product, said powder product being characterized in that it has or can be converted on heating to a substantially uniform chemical composition and microstructure, said powder product being convertible to an end product having predetermined properties and said powder being produced by dry, impact milling particulate components for the powder product in a gravity-dependent type ball mill in the presence of a predetermined amount of process control agent, said method determining the duration of time to produce a powder product having an apparent density of at least about 25% of the fully compacted density of the powder as compacted and extruded, the apparent density being determined according to ASTM Test No. B 212-48 (for flowable powder) or No. B 417-64 (for non-free-flowing powder), using said determination of the duration of time to obtain said apparent density in determining the duration of time for impact milling of the particulate components; whereby the mill throughput is maximized and an acceptable processing level is obtained for the powder product, said acceptable processing level being one criterion for determining whether the powder product is suitable for producing an end product capable of having the predetermined properties.

27. A method according to claim 26, wherein the milling is carried out at a mill speed below critical and at least at about 65% Nc.

28. A method according to claim 26, wherein said apparent density of the powdered product is determined by periodic sampling the powder being milled, and impact milling is terminated when the apparent density of the milled product is at least about 25% of said fully compacted density.

29. A method for the production on a commercial scale of a mechanically alloyed powder product, said powder product being characterized in that it has or can be converted on heating to a substantially uniform chemical composition and microstructure, said powder product being convertible to an end product having predetermined properties and said powder being produced by dry, impact milling particulate components for the powder product in the presence of a predetermined amount of process control agent, said method comprising impact milling said particulate components in the presence of the process control agent, sampling the mill product to ascertain its apparent density the apparent density being determined according to ASTM Test No. B 212-48 (for flowable powder) or No. B 417-64 (for non-free-flowing powder) and terminating the impact milling when the apparent density of the milled product is at least about 25% of the fully compacted density of the powder as compacted and extruded; whereby the mill throughput is maximized and an acceptable processing level is obtained for the powder product, said acceptable processing level being one criterion for determining whether the powder product is suitable for producing an end product capable of having the predetermined properties.

30. A method for the production on a commercial scale of a mechanically alloyed powder product, said powder product being characterized in that it has or can be converted on heating to a substantially uniform chemical composition and microstructure, said powder product being convertible to an end product having predetermined properties and said powder being produced by dry, impact milling particulate components for the powder product in the presence of a predetermined amount of process control agent, said method comprising using apparent density of the powder product for determining whether the powder has been suitably processed in the mill for conversion into said desired end product, to determine thereby at the powder stage that the powder has been suitably processed.

* * * * *